US010467978B2

(12) United States Patent
Oh et al.

(10) Patent No.: US 10,467,978 B2
(45) Date of Patent: Nov. 5, 2019

(54) DISPLAY DEVICE AND METHOD FOR DRIVING THE SAME

(71) Applicant: SAMSUNG DISPLAY CO., LTD., Yongin-si, Gyeonggi-do (KR)

(72) Inventors: Kwanyoung Oh, Hanam-si (KR); Myeongsu Kim, Hwaseong-si (KR); Silyi Bang, Hwaseong-si (KR); Kukhwan Ahn, Hwaseong-si (KR); Jaeho Choi, Seoul (KR); Sangsu Han, Hanam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/787,062

(22) Filed: Oct. 18, 2017

(65) Prior Publication Data

US 2018/0108321 A1 Apr. 19, 2018

(30) Foreign Application Priority Data

Oct. 19, 2016 (KR) ..... 10-2016-0135879

(51) Int. Cl.

| | |
|---|---|
| ***G09G 3/36*** | (2006.01) |
| ***G09G 3/20*** | (2006.01) |
| *G09G 5/00* | (2006.01) |

(52) U.S. Cl.

CPC ..... *G09G 3/3696* (2013.01); *G09G 3/2096* (2013.01); *G09G 3/3685* (2013.01); *G09G 3/3648* (2013.01); *G09G 5/006* (2013.01); *G09G 2310/08* (2013.01); *G09G 2330/021* (2013.01); *G09G 2370/04* (2013.01); *G09G 2370/10* (2013.01)

(58) Field of Classification Search

None

See application file for complete search history.

(56) References Cited

U.S. PATENT DOCUMENTS

| | | | | |
|---|---|---|---|---|
| 2015/0161075 | A1 | 6/2015 | Yoon et al. | |
| 2016/0111042 | A1 * | 4/2016 | Pyeon ..... | G09G 3/3208 345/212 |

FOREIGN PATENT DOCUMENTS

| | | | |
|---|---|---|---|
| KR | 100386945 | B1 | 5/2003 |
| KR | 100848545 | B1 | 7/2008 |
| KR | 101178713 | B1 | 8/2012 |

* cited by examiner

*Primary Examiner* — Kenneth B Lee, Jr.

(74) *Attorney, Agent, or Firm* — Cantor Colburn LLP

(57) ABSTRACT

A display device includes: a timing controller which receives a data control signal from, or outputs the data control signal to, an external device through a wiring, and selectively outputs a power control signal, a display device data signal and a common voltage control signal to a first or second serial communication wiring based on a driving mode determined based on the data control signal; a memory unit which stores the display device data signal, receives the display device data signal from, or outputs the display device data signal to, the timing controller through the first serial communication wiring; and a power generator which receives or outputs the power control signal or the common voltage signal from or to the timing controller through the second serial communication wiring, and generates a voltage adjusted by the power control signal and a common voltage adjusted by the common voltage control signal.

19 Claims, 6 Drawing Sheets

DISPLAY DEVICE AND METHOD FOR DRIVING THE SAME

This application claims priority to Korean Patent Application No. 10-2016-0135879, filed on Oct. 19, 2016, and all the benefits accruing therefrom under 35 U.S.C. § 119, the content of which in its entirety is herein incorporated by reference.

BACKGROUND

1. Field

Exemplary embodiments of the invention relate to a display device and a method of driving the display device, and more particularly, to a display device in which a power for driving the display device is controlled in real time, and a method of driving the display device.

2. Discussion of Related Art

A display device may be classified into a liquid crystal display ("LCD") device, an organic light emitting diode ("OLED") display device, a plasma display panel ("PDP") device, an electrophoretic display device and the like based on a light emitting scheme thereof.

Among them, the LCD device is one of the most widely used types of flat panel display ("FPD") device. The LCD device typically includes two substrates including electrodes provided thereon and a liquid crystal layer interposed therebetween. Upon applying voltage to the two electrodes, liquid crystal molecules of the liquid crystal layer are rearranged such that an amount of transmitted light is controlled in the LCD device Recently, a technique for adjusting a power for driving the display device in real time has been developed.

SUMMARY

Exemplary embodiments of the invention may be directed to a display, in which a power for driving the display device is controlled in real time, and to a method of driving the display device.

According to an exemplary embodiment, a display device includes: a timing controller which receives a data control signal from, or outputting the data control signal to, an external device through a wiring connected to the external device, where the timing controller determines a driving mode based on the data control signal, and selectively outputs a power control signal, a display device data signal and a common voltage control signal to a first serial communication wiring or a second serial communication wiring based on the driving mode; a memory unit which receives the display device data signal from, or outputs the display device data signal to, the timing controller through the first serial communication wiring, where the memory unit stores the display data signal; and a power generator which receives the power control signal or the common voltage signal from, or outputting the power control signal or the common voltage signal to, the timing controller through the second serial communication wiring, where the power generator generates a voltage adjusted based on the power control signal and generates a common voltage adjusted based on the common voltage control signal.

In an exemplary embodiment, the timing controller may include a mode determination unit which determines the driving mode based on the data control signal input from the external device and generates a connection data signal based on the driving mode.

In an exemplary embodiment, the timing controller may further include a connection switching unit which outputs the display device data signal to the first serial communication wiring or the external device, and outputs the power control signal or the common voltage control signal to the second serial communication wiring or the external device, based on the connection data signal.

In an exemplary embodiment, the memory unit may include a first memory unit and a second memory unit, which store the display device data.

In an exemplary embodiment, each of the first memory unit and the second memory unit may be an electrically erasable programmable read only memory ("EEPROM").

In an exemplary embodiment, the timing controller may include an interface unit which converts a form of the data control signal to be communicable in the display device.

In an exemplary embodiment, the interface unit may output the data control signal including the common voltage control signal to the first serial communication wiring or the external device, or output the data control signal including the display device data signal to the second serial communication wiring or the external device.

In an exemplary embodiment, the timing controller may further include a power controller which outputs the power control signal to the second serial communication wiring or the external device.

In an exemplary embodiment, the first serial communication wiring and the second serial communication wiring may include a bidirectional serial bus communication.

In an exemplary embodiment, the second serial communication wiring may be directly connected to the external device.

In an exemplary embodiment, the timing controller may include at least one of an embedded DisplayPort ("eDP") receiver and a low-voltage differential signaling ("LVDS") receiver.

According to another exemplary embodiment, a method of driving a display device includes: receiving a data control signal from an external device; determining a driving mode based on the data control signal; generating a connection information based on the driving mode; and selectively inputting or outputting the data control signal based on the connection information.

In an exemplary embodiment, the driving mode may include at least two modes, and different data signals may be output based on the at least two modes, respectively.

In an exemplary embodiment, the data control signal may be input through at least one signal wiring of an auxiliary wiring ("AUX"), an Enable PIN and a WPN signal line.

The foregoing is illustrative only and is not intended to be in any way limiting. In addition to the illustrative aspects, exemplary embodiments and features described above, further aspects, exemplary embodiments and features will become apparent by reference to the drawings and the following detailed description.

BRIEF DESCRIPTION OF THE DRAWINGS

The above and other features of the invention will become more apparent by describing in detail exemplary embodiments thereof with reference to the accompanying drawings, in which.

DETAILED DESCRIPTION

Figure 1:
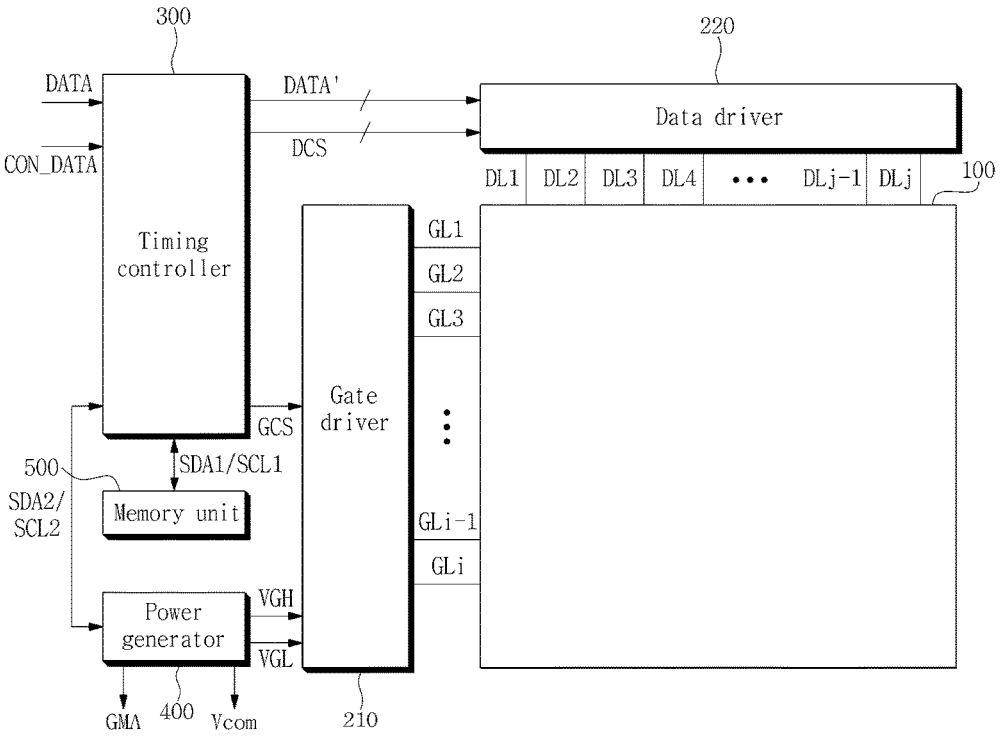
FIG. 1 is a block diagram illustrating a display device according to an exemplary embodiment.

Exemplary embodiments will now be described more fully hereinafter with reference to the accompanying drawings. Although the invention may be modified in various manners and have several exemplary embodiments, exemplary embodiments are illustrated in the accompanying drawings and will be mainly described in the specification. However, the scope of the invention is not limited to the exemplary embodiments and should be construed as including all the changes, equivalents and substitutions included in the spirit and scope of the invention.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be therebetween. Conversely, when a layer, area, or plate is referred to as being "directly below" another layer, area, or plate, intervening layers, areas, or plates may be absent therebetween.

The spatially relative terms "below", "beneath", "lower", "above", "upper" and the like may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in the other direction and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "comprising," "includes" and/or "including," when used in this specification, specify the presence of stated features, integers, steps, operations, elements and/or components, but do not preclude the presence or addition of one or more other features, integers, steps, operations, elements, components and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

Hereinafter, for convenience of description, exemplary embodiments where a display panel is an LCD panel will be described in detail, but exemplary embodiments of the invention are not limited thereto. In an alternative exemplary embodiment, the display panel may be an OLED display panel, a PDP or an electrophoretic display panel.

Figure 2A:
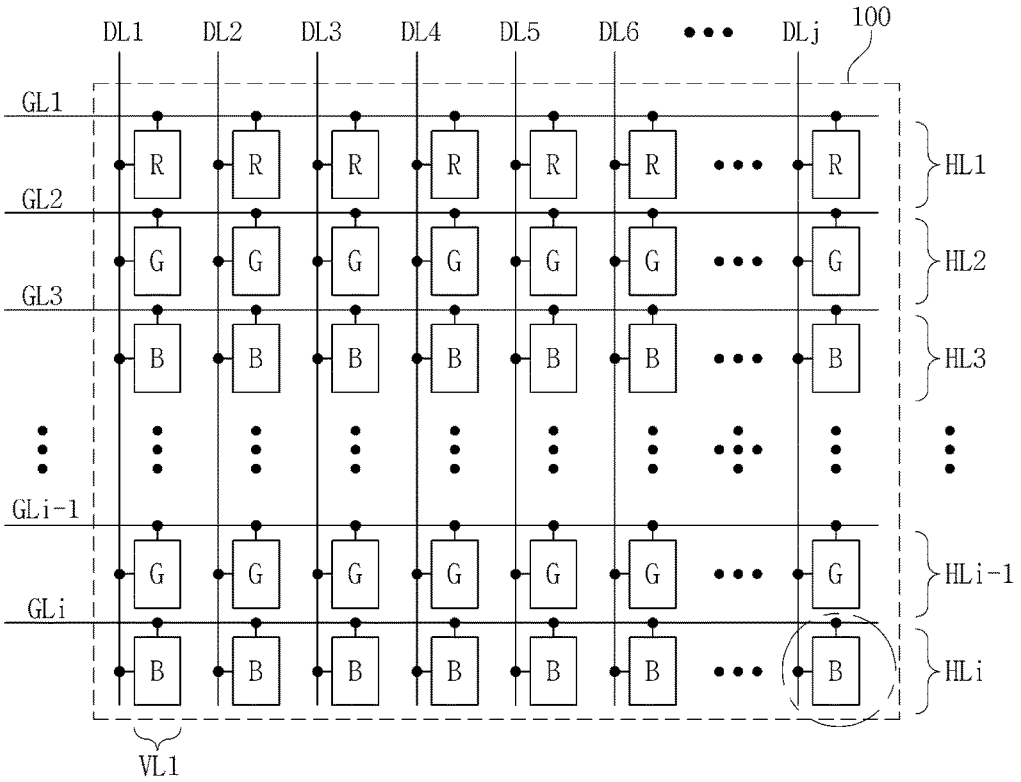
FIG. 2A is a detailed configuration view illustrating a display panel illustrated in FIG. 1.
Figure 2B:
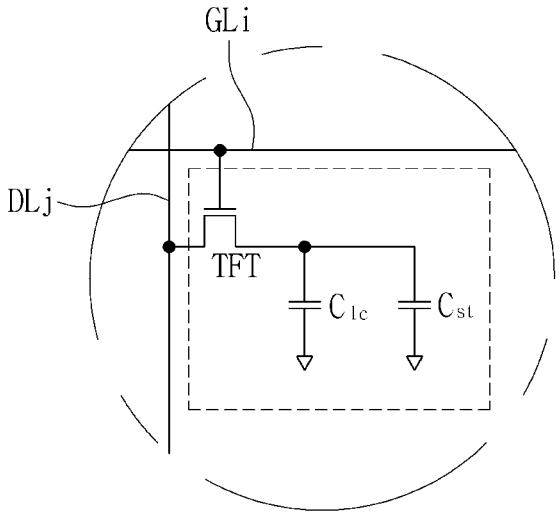
FIG. 2B is an enlarged view of the encircled portion of FIG. 2A.

FIG. 1 is a block diagram illustrating a display device according to an exemplary embodiment, FIG. 2A is a detailed configuration view illustrating a display panel illustrated in FIG. 1, and FIG. 2B is an enlarged view of the encircled portion of FIG. 2A.

As illustrated in FIG. 1, an exemplary embodiment of the display device includes a display panel 100, a timing controller 300, a gate driver 210, a data driver 220, a power generator 400 and a memory unit 500.

The display panel 100 displays an image. The display panel 100 includes a liquid crystal layer (not illustrated), a first substrate (not illustrated) and a second substrate (not illustrated). The first substrate and the second substrate face each other with the liquid crystal layer interposed therebetween. The display panel 100 includes a plurality of gate lines GL1 to GLi, a plurality of data lines DL1 to DLj and a plurality of pixels R, G and B, as illustrated in FIG. 2A.

The gate lines GL1 to GLi intersect the data lines DL1 to DLj.

The pixels R, G and B are arranged along horizontal lines HL1 to HLi. The pixels R, G and B are connected to the gate lines GL1 to GLi and the data lines DL1 to DLj. In one exemplary embodiment, for example, there are "j" number of pixels arranged along an n-th horizontal line (hereinafter, n-th horizontal line pixels), which are connected to the first to j-th data lines DL1 to DLj, respectively. Here, n is a natural number less than or equal to i. In such an embodiment, the n-th horizontal line pixels are connected in common to an n-th gate line. Accordingly, the n-th horizontal line pixels receive an n-th gate signal as a common signal. That is, "j" number of pixels disposed in a same horizontal line receive a same gate signal, while pixels disposed in different horizontal lines receive different gate signals, respectively. In one exemplary embodiment, for example, pixels in a first horizontal line HL1 receive a first gate signal as a common signal, while pixels in a second horizontal line HL2 receive a second gate signal that has a different timing from that of the first gate signal.

In an exemplary embodiment, as illustrated in FIG. 2B, each of the pixels R, G and B includes a thin film transistor ("TFT"), a liquid crystal capacitor Clc and a storage capacitor Cst.

The TFT is turned on based on a gate signal applied from the gate line GLi. The turned-on TFT applies an analog data signal applied from the data line DL1 to the liquid crystal capacitor Clc and the storage capacitor Cst.

The liquid crystal capacitor Clc includes a pixel electrode (not illustrated) and a common electrode (not illustrated) which oppose each other.

The storage capacitor Cst includes a pixel electrode (not illustrated) and an opposing electrode (not illustrated) which oppose each other. Herein, the opposing electrode may be a previous gate line GLi-1 or a transmission line for transmitting a common voltage.

Referring back to FIG. 1, in an exemplary embodiment, the timing controller 300 receives an image data signal DATA output from a graphics controller in an external device, outputs a rearranged image data signal DATA', and inputs or outputs a data control signal CON_DATA.

The timing controller 300 generates a gate control signal GCS for controlling the gate driver 210 and a data control signal DCS for controlling the data driver 220, using the data control signal CON_DATA input thereto. The gate control signal GCS includes a gate start pulse, a gate shift clock, a gate output enable signal, and the like. The data control signal DCS includes a source start pulse, a source shift clock, a source output enable signal, a polarity signal, and the like.

In such an embodiment, the timing controller 300 rearranges the image data signals DATA input thereto through a system and applies the rearranged image data signals DATA' to the data driver 220.

In an exemplary embodiment, the timing controller 300 is driven by a driving power output from the power generator 400 provided in the system. In one exemplary embodiment, for example, the driving power is used as a power voltage of a phase lock loop ("PLL") circuit embedded in the timing controller 300. The PLL circuit compare the frequency of a clock signal input to the timing controller 300 with a reference frequency generated from an oscillator. Then, in the case where it is identified from the comparison that there is a difference between the frequency of the clock signal and the reference frequency, the PPL circuit adjusts the frequency of the clock signal by the difference to generate a sampling clock signal. The sampling clock signal is a signal for sampling the image data signals DATA.

The power generator 400 generates voltages used for the display panel 100 by boosting or lowering a driving power input through an external device. In an exemplary embodiment, the power generator 400 may include, for example, an output switching element for switching an output voltage of an output terminal of the power generator 400 and a pulse width modulator ("PWM") for boosting or lowering the output voltage by controlling a duty ratio or a frequency of a control signal input to a control terminal of the output switching element. Herein, a pulse frequency modulator ("PFM") may be included in the power generator 400 instead of the PWM described above.

The PWM may increase the duty ratio of the aforementioned control signal to increase the output voltage of the power generator 400 or decrease the duty ratio of the control signal to lower the output voltage of the power generator 400. The PFM may increase the frequency of the aforementioned control signal to increase the output voltage of the power generator 400 or decrease the frequency of the control signal to lower the output voltage of the power generator 400. The output voltage of the power generator 400 includes a reference voltage of about 6 volts (V) or greater, gamma reference voltages GMA with a predetermined number of levels (e.g., less than 10 levels), a common voltage in a range of about 2.5 V to about 3.3 V, a gate high voltage VGH of about 15 V or greater, and a gate low voltage VGL of about −4 V or less.

The gamma reference voltages GMA are voltages generated by dividing the voltage of the reference voltage. The reference voltage and the gamma reference voltages GMA are analog gamma voltages, and the reference voltage and the gamma reference voltages GMA are applied to the data driver 220. A common voltage Vcom is provided to the common electrode of the display panel 100 through the data driver 220. The gate high voltage VGH is a high logic voltage of the gate signal, which is set to be equal to or greater than a threshold voltage of a switching element in a pixel, and the gate low voltage VGL is a low logic voltage of the gate signal, which is set to be an off voltage of the switching element. The gate high voltage VGH and the gate low voltage VGL are applied to the gate driver 210.

The gate driver 210 generates gate signals based on the gate control signal GCS provided from the timing controller 300, and sequentially applies the gate signals to the plurality of gate lines GL1 to GLi. The gate driver 210 may include, for example, a shift register that shifts the gate start pulse in response to the gate shift clock to generate the gate signals. The shift register may include a plurality of driving switching elements. The driving switching elements are disposed in a non-display area of the display panel. The driving switching elements may be provided or formed in a substantially same process as a process for forming the switching element of the pixel.

The data driver 220 receives the rearranged image data signals DATA' and the data control signal DCS from the timing controller 300. The data driver 220 samples the rearranged image data signals DATA' based on the data control signal DCS, then latches the sampled image data signals corresponding to one horizontal line in each horizontal period, and applies the latched image data signals to the data lines DL1 to DLj. In one exemplary embodiment, for example, the data driver 220 converts the rearranged image data signals DATA' from the timing controller 300 into analog image data signals using the gamma reference voltages GMA input from the power generator 400, and applies the analog image data signals to the data lines DL1 to DLj.

Figure 3:
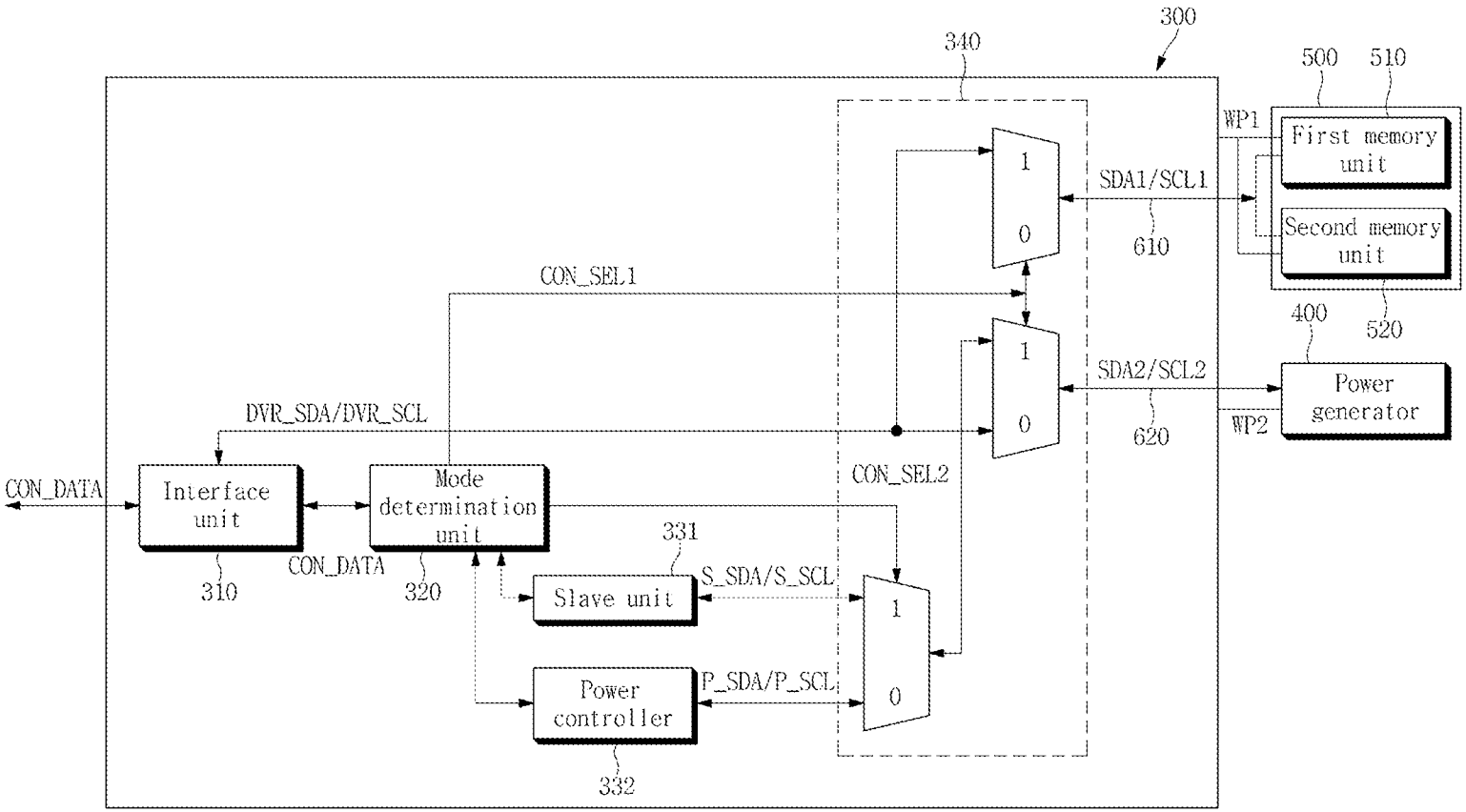
FIG. 3 is a block diagram illustrating a timing controller, a memory unit and a power generator of a display device according to an exemplary embodiment.

FIG. 3 is a block diagram illustrating a timing controller, a memory unit and a power generator of a display device according to an exemplary embodiment. Hereinafter, the timing controller 300, the memory unit 500 and the power generator 400 of an exemplary embodiment of a display device will be described in detail with reference to FIG. 3.

According to an exemplary embodiment, the timing controller 300 includes an interface unit 310, a mode determination unit 320, a slave unit 331, a power controller 332 and a connection switching unit 340.

In an exemplary embodiment, as shown in FIG. 3, the interface unit 310 may be embedded in the timing controller 300. In such an embodiment, signals output from the external device may be input to the timing controller 300 through the interface unit 310. In one exemplary embodiment, for example, a data control signal CON_DATA output from the external device may be input to the timing controller 300 through the interface unit 310. In an alternative exemplary embodiment, the interface unit 310 may be disposed outside the timing controller 300, and provided between an external device (not illustrated) and the timing controller 300.

The interface unit 310 may convert signals input from the external device into signal having a form that may be transmitted or received in the timing controller 300, and output the converted signals to the mode determination unit 320 or the connection switching unit 340. Alternatively, the interface unit 310 may convert signals in a bidirectional serial bus communication (also referred to as I2C) scheme in the timing controller 300 into signals in a scheme corresponding to the external device, and output the converted signals to the external device.

The interface unit 310 may be connected to a second serial communication wiring 620 through the connection switching unit 340 to be described below, and output the data control signal CON_DATA including a common voltage control signal to be described below to the second serial communication wiring 620. In one exemplary embodiment, for example, the interface unit 310 may output the data control signal CON_DATA including the common voltage control signal to be described below to the second serial communication wiring 620. The data control signal CON_DATA output to the second serial communication wiring 620 may be output to the power generator 400 to be described below. Accordingly, the common voltage is controlled by the power generator 400 to be described below such that flickering occurring in the display device may be effectively prevented. In an exemplary embodiment, the interface unit 310 may read a set value of the power controller 332, to be described below, from the power generator 400 through the second serial communication wiring 620, and output the set value to the external device.

The interface unit 310 may output the data control signal CON_DATA including a display device data signal to a first serial communication wiring 610 or the external device. In one exemplary embodiment, for example, the interface unit 310 may output the data control signal CON_DATA input from the external device to the memory unit 500 through the first serial communication wiring 610. In such an embodiment, the interface unit 310 may read the data control signal CON_DATA including the display device data signal from the memory unit 500, and output the data control signal CON_DATA to the external device.

The interface unit 310 may be connected to the connection switching unit 340, to be described below, by two signal lines DVR_SDA and DVR_SCL.

According to an exemplary embodiment, the interface unit 310 may include an embedded DisplayPort ("eDP") receiver. In such an embodiment, due to high frequency components of a signal input to the timing controller 300, electromagnetic interference ("EMI") may occur therebetween. In an exemplary embodiment, an EMI filter (not illustrated) may be further provided in the interface unit 310 to effectively prevent the EMI.

The mode determination unit 320 may determine a mode information from the data control signal CON_DATA converted by the interface unit 310. In one exemplary embodiment, for example, a mode of the display device may be determined based on data input to a DisplayPort configuration data ("DPCD") user area of the converted data control signal CON_DATA. Alternatively, a driving mode of the display device may be determined based on the data control signal CON_DATA input to an auxiliary wiring ("AUX"), an Enable PIN or a WPN signal line directly connected to an external device.

According to the driving mode of the display device, the mode determination unit 320 may generate connection data signals including a first connection data signal CON_SEL1 and a second connection data signal CON_SEL2, and output the connection data signals CON_SEL1 and CON_SEL2 to the connection switching unit 340.

The slave unit 331 may be connected to the connection switching unit 340, to be described below, by two signal lines S_SDA and S_SCL in the timing controller 300.

The slave unit 331 may output set values for driving the display device to an external device.

The slave unit 331 may be connected to the second serial communication wiring 620, as illustrated in FIG. 3. The second serial communication wiring 620 may include a bidirectional serial bus communication (that is, I2C). In such an embodiment, the second serial communication wiring 620 may include a second serial data line SDA2 and a second serial clock line SCL2.

The power controller 332 may be connected to the connection switching unit 340, to be described below, by two signal lines P_SDA and P_SCL in the timing controller 300.

The power controller 332 outputs a power control signal for controlling a voltage for driving the display panel 100 to the connection switching unit 340 based on a separate algorithm. In one exemplary embodiment, for example, the power controller 332 calculates a set value for generating a voltage, such as the gamma reference voltage GMA, the gate high voltage VGH and the gate low voltage VGL, by a separate algorithm to output the set value to the connection switching unit 340.

The power controller 332 may be connected to the second serial communication wiring 620 through the connection switching unit 340, as illustrated in FIG. 3. In an exemplary embodiment, the second serial communication wiring 620 may include a bidirectional serial bus communication. In such an embodiment, the second serial communication wiring 620 may include the second serial data line SDA2 and the second serial clock line SCL2. In such an embodiment, the power controller 332 may output the power control signal to the power generator 400 through the second serial communication wiring 620.

The slave unit 331 and the power controller 332 may be connected to the second serial communication wiring 620 to receive the power control signal from or output the power control signal to the power generator 400. Alternatively, a separate external device for replacing the power generator 400 may be connected to the second serial communication wiring 620 such that the slave unit 331 may receive the power control signal from or output the power control signal to the separate external device.

The connection switching unit 340 receives the connection data signals CON_SEL1 and CON_SEL2 output from the mode determination unit 320, and selectively outputs a signal through the first serial communication wiring 610 or the second serial communication wiring 620. In one exemplary embodiment, for example, the connection switching unit 340 receives the connection data signals CON_SEL1 and CON_SEL2 generated in the mode determination unit 320 based on the driving mode of the display device, and switches connection of the interface unit 310, the slave unit 331 and the power controller 332 with the first serial communication wiring 610 or the second serial communication wiring 620 based on the connection data signals CON_SEL1 and CON_SEL2. In such an embodiment, the connection switching unit 340 may receive the display device data signal from the interface unit 310 to output the display device data signal to the memory unit 500, or receive the display device data signal from the memory unit 500 to output the display device data signal to an external device, through the first serial communication wiring 610 based on the driving mode of the display device. In such an embodiment, the connection switching unit 340 may receive the power control signal or the common voltage control signal from the interface unit 310, the slave unit 331 and the power controller 332 to output the power control signal or the common voltage control signal to the power generator 400, or receive the power control signal or the common voltage control signal from the power generator 400 to output the power control signal or the common voltage control signal to an external device, through the second serial communication wiring 620.

The memory unit 500 may include a first memory unit 510 and a second memory unit 520. The first memory unit 510 and the second memory unit 520 may store data for the display device. In one exemplary embodiment, for example, the first memory unit 510 may store extended display identification data ("EDID"). In such an embodiment, the second memory unit 520 may store data for image display control. In one exemplary embodiment, for example, a clock signal, a horizontal start signal, a vertical start signal and a gamma reference voltage may be stored.

The memory unit 500 may output the data stored in the memory unit 500 to the timing controller 300. In an exemplary embodiment, the memory unit 500 may be an electrically erasable and programmable read only memory ("EEPROM"). The EEPROM may be connected to a memory writer (not illustrated) before completion of the finished product of the display device to perform a write function and then may only perform a read function after completion of the finished product of the display device. The memory unit 500 may receive a write protect signal from the timing controller 300 through a first write protect signal line WP1 to perform only the read function.

The memory unit 500 is connected to the timing controller 300 through the first serial communication wiring 610. The first memory unit 510 and the second memory unit 520 share the first serial communication wiring 610. In an exemplary embodiment, the first serial communication wiring 610 may include a bidirectional serial bus communication. In such an embodiment, the first memory unit 510 and the second memory unit 520 share the first serial clock line SCL1, the first serial data line SDA1 and the first write protect signal line WP1, which are the first serial communication wiring 610. The memory unit 500 receives the display device data signal from the connection switching unit 340 or output the display device data signal stored in the memory unit 500 to the connection switching unit 340, through the first serial communication wiring 610.

The power generator 400 is connected to the timing controller 300 through the second serial communication wiring 620. In an exemplary embodiment, the second serial communication wiring 620 may include a bidirectional serial bus communication. In such an embodiment, the power generator 400 is connected to the timing controller 300 through the second serial clock line SCL2, the second serial data line SDA2 and a second write protect signal line WP2, which are the second serial communication wiring 620. The power generator 400 receives the power control signal or the common voltage control signal from the timing controller 300 or outputs the power control signal or the common voltage control signal stored in the power generator 400 to the connection switching unit 340, through the second serial communication wiring 620.

The power generator 400 may include a resistance adjustor (not illustrated). Although not illustrated, the resistance adjustor includes a variable resistor and adjusts the resistance based on the common voltage control signal input to the power generator 400. Accordingly, the resistance adjustor may effectively prevent flickering that may occur in the display device by adjusting the magnitude of the common voltage Vcom.

Figure 4:
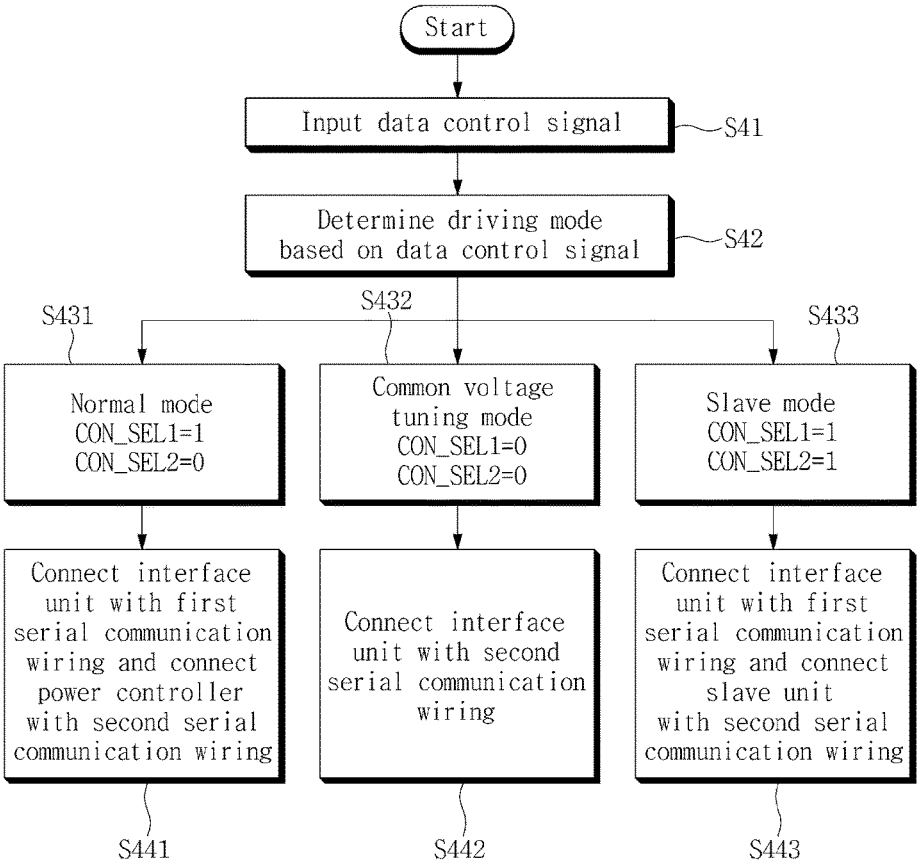
FIG. 4 is a flowchart illustrating a driving method according to an exemplary embodiment.

FIG. 4 is a flowchart illustrating a driving method according to an exemplary embodiment. Hereinafter, an exemplary embodiment of a driving method of a display device according to the invention will be described in detail with reference to FIG. 4.

In an exemplary embodiment, the data control signal CON_DATA is input (S41). In one exemplary embodiment, for example, the interface unit 310 receives the data control signal CON_DATA. The data control signal CON_DATA may be converted by the interface unit 310 into a signal having a form that may be transmitted or received in the timing controller 300. In one exemplary embodiment, for example, the data control signal CON_DATA may be converted into a bidirectional serial bus communication signal by the interface unit 310.

Subsequently, the driving mode of the display device is determined based on the data control signal CON_DATA (S42). In one exemplary embodiment, for example, the mode determination unit 320 extracts a mode information from the data control signal CON_DATA input from the interface unit 310 to determine the driving mode of the display device. In one exemplary embodiment, for example, where the timing controller 300 including an eDP receiver, the driving mode of the display device may be determined based on the data input to the DPCD user area of the data control signal CON_DATA. Alternatively, the driving mode of the display device may be determined based on the data control signal CON_DATA input to the Enable PIN or the WPN signal line connected to an external device.

In an exemplary embodiment, the driving mode of the display device includes a normal mode (S431), a common voltage tuning mode (S432) and a slave mode (S433). Each driving mode may be changed based on the use environment of the display device and the driving mode of the display device may be determined based on the data control signal CON_DATA. The mode determination unit 320 may generate and output the connection data signals CON_SEL1 and CON_SEL2 corresponding to the driving mode of the display device.

In an exemplary embodiment, the first connection data signal CON_SEL1 may have a value of 1 in the normal mode (S431). Accordingly, the interface unit 310 is connected to the first serial communication wiring 610 by the connection switching unit 340 (S441) such that the interface unit 310 secures communication with the memory unit 500 through the first serial communication wiring 610. Accordingly, an external device connected to the interface unit 310 may read the display device data stored in the memory unit 500. In one exemplary embodiment, for example, an external device connected to the interface unit 310 may read EDID stored in the first memory unit 510. In such an embodiment, the second connection data signal CON_SEL2 may have a value of 0 in the normal mode (S431). Accordingly, the power controller 332 is connected to the second serial communication wiring 620 by the connection switching unit 340 (S441) such that the power controller 332 secures communication with the power generator 400 through the second serial communication wiring 620. Accordingly, the power controller 332 may output the power control signal for adjusting the voltage for driving the display device, such as the gamma reference voltage GMA, the gate high voltage VGH and the gate low voltage VGL, to the power generator 400.

In such an embodiment, the memory unit 500 may receive a high logic signal from the timing controller 300 through the first write protect signal line WP1 to perform only the read function and may receive a low logic signal through the first write protect signal line WP1 to perform the write function using the interface unit 310.

According to an exemplary embodiment, the memory unit 500 and the power generator 400 are connected to different serial communication wirings, respectively. In one exemplary embodiment, for example, the memory unit 500 is connected to the first serial communication wiring 610, and the power generator 400 is connected to the second serial communication wiring 620. Accordingly, a signal output to the power generator 400 by the timing controller 300 and a signal output to the memory unit 500 by the timing controller 300 do not collide with each other. In such an embodiment, since the timing controller 300 is connected to the memory unit 500 and the power generator 400 through different serial communication wirings, respectively, no collision occurs between the signals input to or output from the timing controller 300, and thus reliable communication may be realized.

In an exemplary embodiment, the first connection data signal CON_SEL1 may have a value of 0 and the second connection data signal CON_SEL2 may have a value of 0 (S432) in the common voltage tuning mode. Accordingly, the interface unit 310 is connected to the second serial communication wiring 620 by the connection switching unit 340 (S442) such that the interface unit 310 secures communication with the power generator 400 connected to the second serial communication wiring 620 and the interface unit 310 may output the common voltage control signal for adjusting a set value of the resistance adjustor in the power generator 400. In one exemplary embodiment, for example, a resistance value of the variable resistor included in the resistance adjustor may be changed by the signal output from the interface unit 310, so that the common voltage may be controlled. Accordingly, in such an embodiment, flickering is effectively prevented from occurring in the display device.

In such an embodiment, the power generator 400 may receive a write protect signal or an inverted signal of the write protect signal from the timing controller 300 to perform a read function.

In an exemplary embodiment, the first connection data signal CON_SEL1 and the second connection data signal CON_SEL2 may each have a value of 1 (S433) in the slave mode. Accordingly, the interface unit 310 is connected to the first serial communication wiring 610 and the slave unit 331 is connected to the second serial communication wiring 620, by the connection switching unit 340 (S443). In such an embodiment, the second serial communication wiring 620 may be connected to a separate external device. In one exemplary embodiment, for example, the separate external device may read the data stored in the timing controller 300 through the slave unit 331.

In an exemplary embodiment, as illustrated in FIG. 4, the interface unit 310, the mode determination unit 320, the slave unit 331 and the power controller 332 are connected to the first serial communication wiring 610 or the second serial communication wiring 620 based on the driving mode of the display device. Accordingly, the timing controller 300 may output different signals based on the driving mode of the display device.

Figure 5:
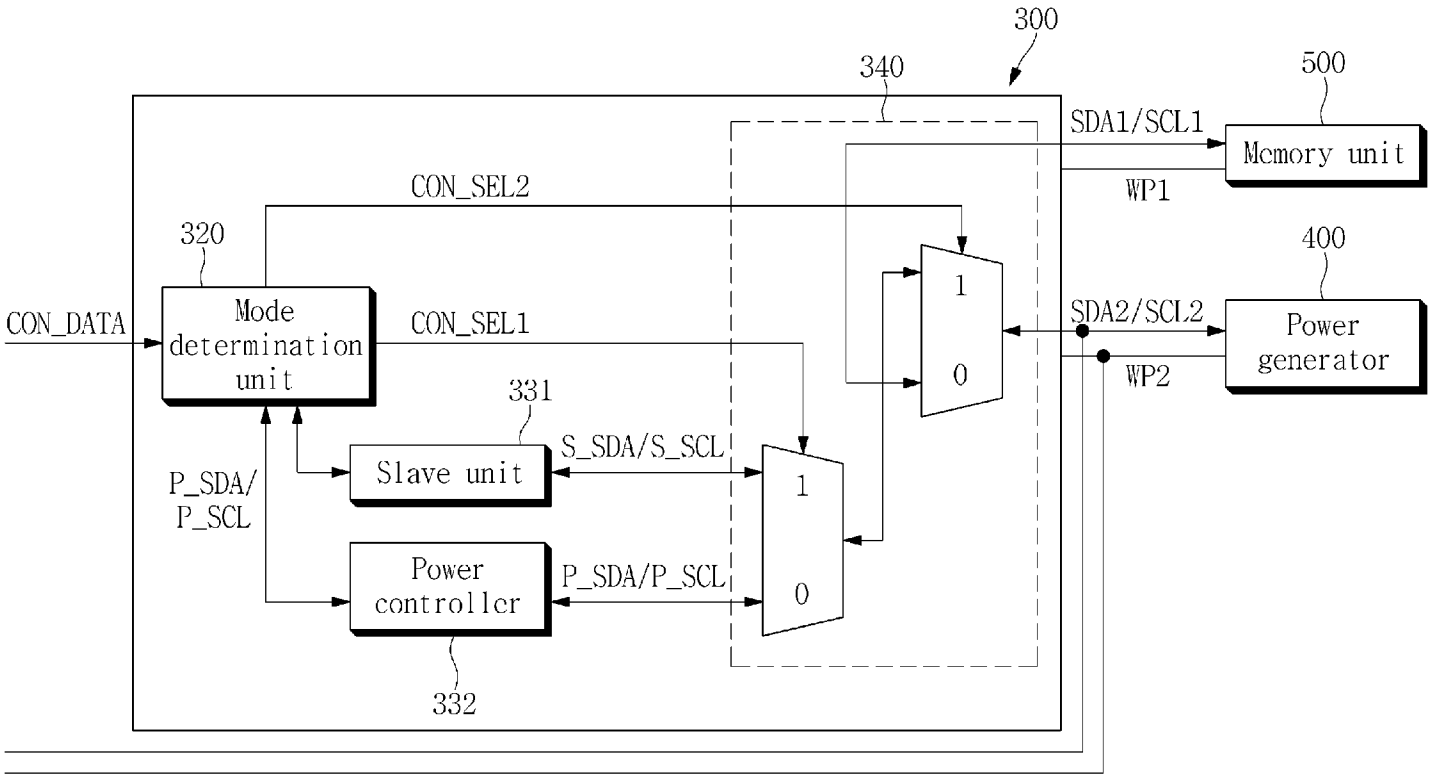
FIG. 5 is a block diagram illustrating a timing controller, a memory unit and a power generator of a display device according to an alternative exemplary embodiment.

FIG. 5 is a block diagram illustrating a timing controller, a memory unit and a power generator of a display device according to an alternative exemplary embodiment.

The block diagram in FIG. 5 is substantially the same as the circuit diagram shown in FIG. 3 except for the timing controller 300. The same or like elements shown in FIG. 7 have been labeled with the same reference characters as used above to describe the exemplary embodiments of the timing controller, the memory unit and the power generator shown in FIG. 3, and any repetitive detailed description thereof will hereinafter be omitted or simplified.

According to an exemplary embodiment, a timing controller 300 includes a mode determination unit 320, a slave unit 331, a power controller 332 and a connection switching unit 340.

In such an embodiment, the timing controller 300 may further include a low-voltage differential signaling ("LVDS") receiver (not shown).

The mode determination unit 320 may determine a mode information from a data control signal CON_DATA directly input from an external device. In one exemplary embodiment, for example, the mode determination unit 320 may receive the data control signal CON_DATA through a control wiring, such as an Enable PIN, a WP signal line or a WPN signal line, which is directly connected to the external device, and may determine the driving mode of the display device based on the data control signal CON_DATA.

In such an embodiment, the mode determination unit 320 may generate and output connection data signals, including a first connection data signal CON_SEL1 and a second connection data signal CON_SEL2, based on the driving mode of the display device.

Accordingly, the timing controller 300 may input or output a power control signal of a power generator 400 through a first serial communication wiring 610 and may input or output a power control signal, a display device data signal and a common voltage control signal through a second serial communication wiring 620.

In such an embodiment, the second serial communication wiring 620 may be directly connected to an external device.

As set forth hereinabove, according to exemplary embodiments of the display device and the method of driving the display device, the timing controller is connected to the memory unit and the power generator through different serial communication wirings, respectively, such that a collision does not occur between signals input from or output to the timing controller and thus reliable communication may be available at a time. Accordingly, in such embodiments, the power for driving the display device may be controlled in real time.

While the invention has been illustrated and described with reference to the exemplary embodiments thereof, it will be apparent to those of ordinary skill in the art that various changes in form and detail may be made thereto without departing from the spirit and scope of the invention.

What is claimed is:

1. A display device comprising:

a timing controller which receives a data control signal from, or outputs the data control signal to, an external device through a wiring connected to the external device, wherein the timing controller determines a driving mode based on the data control signal, and selectively outputs a power control signal, a display device data signal and a common voltage control signal to a first serial communication wiring or a second serial communication wiring based on the driving mode;

a memory unit which receives the display device data signal from, or outputs the display device data signal to, the timing controller through the first serial communication wiring, wherein the memory unit stores the display device data signal; and a power generator which receives the power control signal or the common voltage control signal from the timing controller thorough the second serial communication wiring, wherein the power generator outputs the power control signal or the common voltage control signal to the timing controller through the second serial communication wiring, wherein the power generator generates a voltage adjusted based on the power control signal and generates a common voltage adjusted based on the common voltage control signal.

2. The display device as claimed in claim 1, wherein the timing controller comprises a mode determination unit which determines the driving mode based on the data control signal input from the external device and generates a connection data signal based on the driving mode.

3. A display device comprising:

a timing controller which receives a data control signal from, or outputs the data control signal to, an external device through a wiring connected to the external device, wherein the timing controller determines a driving mode based on the data control signal, and selectively outputs a power control signal, a display device data signal and a common voltage control signal to a first serial communication wiring or a second serial communication wiring based on the driving mode;

a memory unit which receives the display device data signal from, or outputs the display device data signal to, the timing controller through the first serial communication wiring, wherein the memory unit stores the display device data signal; and a power generator which receives the power control signal or the common voltage control signal from, or outputs the power control signal or the common voltage control signal, to the timing controller through the second serial communication wiring, wherein the power generator generates a voltage adjusted based on the power control signal and generates a common voltage adjusted based on the common voltage control signal, wherein the timing controller comprises a mode determination unit which determines the driving mode on the data control signal input from the external device and generates a connection data signal based on the driving mode; and a connection switching unit which outputs the display device data signal to the first serial communication wiring or the external device, and outputs the power control signal or the common voltage control signal to the second serial communication wiring or the external device, based on the connection data signal.

4. The display device as claimed in claim 1, wherein the memory unit comprises a first memory unit and a second memory unit, which store the display device data.

5. The display device as claimed in claim 4, wherein each of the first memory unit and the second memory unit is an electrically erasable programmable read only memory.

6. The display device as claimed in claim 1, wherein the timing controller comprises an interface unit which converts a form of the data control signal to be communicable in the display device.

7. The display device as claimed in claim 6, wherein the interface unit outputs the data control signal comprising the common voltage control signal to the first serial communication wiring or the external device, or outputs the data control signal comprising the display device data signal to the second serial communication wiring or the external device.

8. The display device as claimed in claim 1, wherein the timing controller comprises a power controller which outputs the power control signal to the second serial communication wiring or the external device.

9. The display device as claimed in claim 1, wherein each of the first serial communication wiring and the second serial communication wiring comprises a bidirectional serial bus communication.

10. The display device as claimed in claim 1, wherein the second serial communication wiring is directly connected to the external device.

11. The display device as claimed in claim 1, wherein the timing controller comprises at least one of an embedded DisplayPort receiver and a low-voltage differential signaling receiver.

12. A method of driving a display device, the method comprising:

receiving a data control signal from an external device;

determining a driving mode based on the data control signal;

generating a connection information for a timing controller connected to two different units based on the driving mode; and selectively inputting or outputting the data control signal to or from the timing controller via a first serial communication wiring connected to a first unit of the two different units or via a second serial communication wiring connected to a second unit of the two different units based on the connection information.

13. The method as claimed in claim 12, wherein the driving mode comprises at least two driving modes, and different data signals are output based on the at least two driving modes, respectively.

14. The method as claimed in claim 12, wherein the data control signal is input through at least one signal wiring of an auxiliary wiring, an Enable PIN and a WPN signal line.

15. The method as claimed in claim 12, wherein the two separate units include a memory unit and a power generator.

16. The method as claimed in claim 15, wherein the timing controller is connected to the memory unit and the power generator through different serial communication wirings, respectively, such that no collision occurs between signals input to or output from the timing controller to allow reliable communication to be realized therebetween.

17. The display device as claimed in claim 3, wherein, the timing controller comprises a power controller which outputs the power control signal to the second serial communication wiring or the external device, and an interface unit which converts a form of the data control signal to be communicable in the display device, the connection data signal includes a first connection data signal and a second connection data signal, the interface unit is connected with the first serial communication wiring by the connection switching unit, and the power controller is connected with the second serial communication wiring by the connection switching unit when the first connection data signal has a value of 1 and the second connection data signal has a value of 0.

18. The display device as claimed in claim 3, wherein, the timing controller comprises a power controller which outputs the power control signal to the second serial communication wiring or the external device, and an interface unit which converts a form of the data control signal to be communicable in the display device, the connection data signal includes a first connection data signal and a second connection data signal, the interface unit is connected with the second serial communication wiring by the connection switching unit when the first connection data signal has a value of 0 and the second connection data signal has a value of 0.

19. The display device as claimed in claim 3, wherein, the timing controller comprises a slave unit connected to the connection switching unit, and an interface unit which converts a form of the data control signal to be communicable in the display device, the connection data signal includes a first connection data signal and a second connection data signal, the interface unit is connected with the first serial communication wiring by the connection switching unit, and the slave unit is connected with the second serial communication wiring by the connection switching unit when the first connection data signal has a value of 1 and the second connection data signal has a value of 1.

* * * * *